United States Patent [19]

Jaatinen

[11] Patent Number: 4,610,474

[45] Date of Patent: Sep. 9, 1986

[54] LIFEBOAT RELEASE HOOK

[75] Inventor: Jari Jaatinen, Turku, Finland

[73] Assignee: Oy Fiskars Ab Veneveistamo, Turku, Finland

[21] Appl. No.: 703,931

[22] Filed: Feb. 21, 1985

[30] Foreign Application Priority Data

Feb. 22, 1984 [FI] Finland ..... 840719

[51] Int. Cl.[4] ..... B63B 23/58; B66C 1/36

[52] U.S. Cl. ..... 294/82.27; 114/378; 294/82.31; 294/82.34

[58] Field of Search ..... 294/82.24–82.27, 294/82.3–82.34, 82.36; 24/230.5 R, 232 R, 238, 241 P; 114/249, 252, 378–380

[56] References Cited

U.S. PATENT DOCUMENTS

| | | | |
|---|---|---|---|
| 1,275,265 | 8/1918 | Keil | 24/241 P |
| 1,308,549 | 7/1919 | McGowan | 114/379 |
| 2,476,734 | 7/1949 | Jellison | 294/82.31 X |
| 2,714,731 | 8/1955 | Binmore | 294/82.27 X |
| 2,864,644 | 12/1958 | Marryatt | 294/82.31 X |
| 3,873,146 | 3/1975 | Houshar | 294/82.3 |
| 4,095,833 | 6/1978 | Lewis | 294/82.3 |
| 4,281,867 | 8/1981 | Kariagin | 294/82.27 X |

*Primary Examiner*—Johnny D. Cherry

*Attorney, Agent, or Firm*—Karl F. Ross; Herbert Dubno

[57] ABSTRACT

A device for disengaging a wire loop or cable loop either when the hook (2) is unloaded or loaded, when, in the first case, only the locking pivot (9) is removed, or, in the second case, the load is moved onto a hydraulic system (8), whereafter the pivot (9) can be removed and disengagement takes place by discharging the pressure from the hydraulic system (8). After disengagement the hook (2) returns by itself to its original position and can instantly be relocked by the pivot (9) for reloading. Additional safety mechanism can be provided if necessary.

2 Claims, 2 Drawing Figures

LIFEBOAT RELEASE HOOK

FIELD OF THE INVENTION

A quick method for loosening wire loops is necessary, particularly for disengaging life boats from davit wire loops. The invention relates to a device for this purpose.

BACKGROUND OF THE INVENTION

Two lifting cables are needed for lifeboats; one is fastened to the hook in the bow of the boat and the other to the hook in the stern. As both hooks must be loosened from the loop simultaneously, the disengagement has to be performed by remote control. Either release wires or hydraulics are used. This is also the case with the present invention.

It is, furthermore, common for the hooks to be mounted in bearings between two supporting plates, so that the plates, if correctly designed, help in loosening the loop when the hook turns. This is also the case with a hook designed in accordance with the present invention.

Most disengaging devices function only when the hook is not loaded, others only when the hook is loaded, and all only when the safety lock is released. Usually they cannot be re-engaged after disengagement without fairly complicated measures. Many of the devices are complicated in structure, which makes them heavy and expensive.

SUMMARY OF THE INVENTION

The disengaging device in accordance with the present invention functions both when loaded and unloaded when the safety lock has been released. This fulfills resolution MSC 48/3 of the International Martime Organisation. The hook can, moreover, be returned to loading order quickly and its structure is relatively simple. According to the invention, the device for disengaging a loaded or unloaded hook, after any existing safety mechanism has been released, either by a wire or by hydraulic remote control, which enables the simultaneous disengagement of several hooks, and which returns by gravity to its original position where it can be re-engaged for reloading, comprises a pivot, which locks the hook in its position and which can be released by remote control only when the pivot is free, is, when the hook is loaded, first released from the load of the hook it locks, by moving the load of the hook onto a remotely controlled cylinder and piston so that the hook is then disengaged only after the pressure is discharged from the cylinder by remote control.

The movements of the hook are controlled, when the load is removed from the locking pivot, the holding loop being loosened from the hook, when the hook moves into a new position and when the hook returns to its original position, by shaped grooves or slots on the supporting plates in which the pivots or guide pins, fastened to the hook, move.

In order to simplify fastening the load loop to the hook, a wire or rope loop attached to the load loop can first be fastened to a hole in the supporting plate in which a locking pin secures the fastening.

BRIEF DESCRIPTION OF THE DRAWING

In FIG. 1 the hook is in the position where it can be loaded. One of the supporting plates 1 on the viewer's side has been broken away.

FIG. 2 shows the hook in its extreme position after disengagement. The necessary additional pieces are drawn in a thin line dotted behind the supporting plate, and the sectioned parts of the pieces are indicated by diagonal lines.

Figure 1:
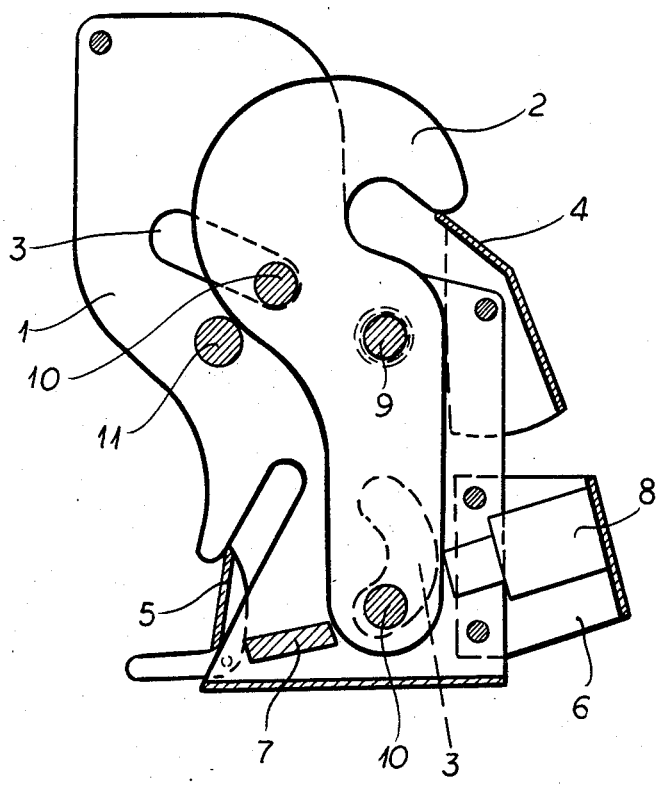
FIGS. 1 and 2 show one of the hooks.
Figure 2:
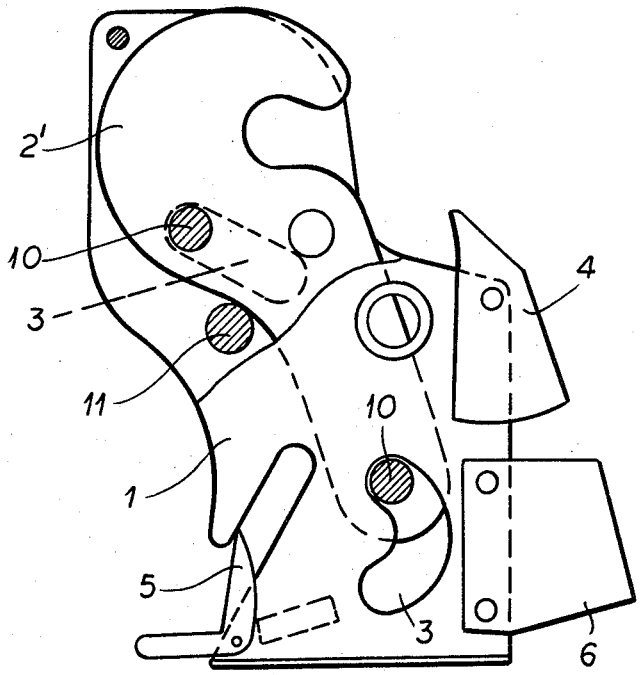

The loop of the wire or cable can easily be fastened to hook 2, and the fastening is secured by a bolt pin 4 or stop. When hook 2 is unloaded, locking pin 9, which moves in a tube, can be drawn aside axially (perpendicular to the plane of the figure) with a remote control cable or hydraulic transmission, so that the load will tend to draw hook 2 toward position 2'.

Thereafter guide pins 10 fastened to the hook move in shaped grooves or slots 3 on supporting plate 1 from one end of the slot to the other, and the edge of supporting plate 1 releases the loop from the hook. After disengagement the hook returns to position 2 by the force of gravity back to its original position 2; locking pin 9 can be pushed back, and hook 2 is ready for reloading. As locking pivot 9 is moved by remote control by a cable or hydraulically, e.g. with a hand pump, for the required number of hooks, two in case of a life boat, function simultaneously. If required, additional locking can be provided for the remote control cable or for the control apparatus of the hydraulic device.

When hook 2 is loaded, the load, locked into its position by locking pivot 9, can be transferred by remote control onto hydraulic cylinder 6 and piston 8 fastened on supporting plates 1 and pressing the bottom end of the hook against a stop plate 7. Locking pin 9 can thereafter be removed as when the hook was not loaded, but disengagement does not take place, as hydraulic unit 8 lock the hook in its position. The holding loop is released by discharging the pressure from the hydraulic system, when any existing safety mechanism has first been released. The hook is then prepared for reloading as above, by pushing locking pin 9 back into locking position.

The movements of hook 2 between the supporting plates when hydraulic unit 8 pushes it slightly downwards in order to facilitate release of pin 9 from the load, or when the holding loop is released from the hook, or when the hook returns to its original position for reloading are controlled by shaped grooves 3, in which guide pins fastened on the hook, slide. 11 is a supporting pin guiding the movements of hook 2.

When fastening the holding loop in difficult conditions, it is, because of its weight, often necessary to fasten it first to the boat with the help of a few meters long thin wire or rope loop. This loop can be fastened to the supporting plates of the hook with locking pin 5, whereafter it is much less dangerous to fasten the actual holding loop to hook 2.

What we claim is:

1. A lifeboat hook assembly which comprises:

a pair of plates adapted to be affixed to a lifeboat;

a hook received between said plates, said plates being provided with spaced apart pairs of guide slots;

respective guide pins affixed to said hook and each engaging in a pair of slots of the two plates for guiding said hook between a loop-engaging loaded position and a loop-releasing disengaged position;

a stop affixed to said plates cooperating with an upper end of said hook for said loop-engaging loaded position for retaining a loop from which the life-boat may be suspended in said hook, said hook moving away from said stop into said loop-releasing position for disengagement from said loop;

a locking pin displaceable perpendicularly to said plates and mounted on at least one of said plates for releasable engagement with said hook when said hook is in said loop-engaging loaded position for retaining said hook in said loop-engaging loaded position under loading caused by suspension of the life boat from the loop; and a hydraulic piston-and-cylinder unit mounted on said plates and actuatable to brace against a lower portion of said hook for releasably retaining same in said loop-engaging loaded position upon withdrawal of said locking pin from engagement with said hook, whereby depressurization of said unit enables loading of said hook to cause its displacement between said loop-engaging loaded position and said loop-releasing position.

2. The assembly defined in claim 1, further comprising a latch for engaging a loop enabling the insertion of a wire loop in said hook in said loop-engaging position of said hook.

* * * * *